US005303917A

United States Patent [19]

Uke

[11] Patent Number: 5,303,917

[45] Date of Patent: Apr. 19, 1994

[54] BAT FOR BASEBALL OR SOFTBALL

[76] Inventor: Alan K. Uke, 5980 Rancho Diegueno, P.O. Box 8531, Rancho Santa Fe, Calif. 92067

[21] Appl. No.: 867,495

[22] Filed: Apr. 13, 1992

[51] Int. Cl.[5] ..... A63B 59/06

[52] U.S. Cl. ..... 273/72 R

[58] Field of Search ..... 273/72, 266, 67

[56] References Cited

U.S. PATENT DOCUMENTS

| | | | |
|---|---|---|---|
| 2,340,156 | 1/1944 | Taylor | 273/72 A |
| 3,377,066 | 4/1968 | Trowbridge | 273/72 R |
| 3,479,030 | 11/1969 | Merola | 273/72 A |
| 3,830,496 | 8/1974 | Reizer | 273/DIG. 7 |
| 3,877,698 | 4/1975 | Volpe | 273/72 R |
| 3,955,816 | 5/1976 | Bratt | 273/72 R |
| 4,684,131 | 8/1987 | Mortvedt | 273/73 F |
| 4,725,059 | 2/1988 | Du Gardin et al. | 273/73 G |
| 4,725,060 | 2/1988 | Iwanaga | 273/77 A |
| 4,836,545 | 6/1989 | Pompa | 273/80 B |
| 4,848,745 | 7/1989 | Bohannan et al. | 273/72 R |
| 4,951,948 | 8/1990 | Peng | 273/72 R |
| 5,094,453 | 3/1992 | Douglas | 273/72 R |

*Primary Examiner*—Mark S. Graham

*Attorney, Agent, or Firm*—Brown, Martin, Haller & McClain

[57] ABSTRACT

A bat for baseball, softball or other sporting games comprises a first member extending from a first, butt end of the bat to form a handle region of a first diameter, and a second member extending from the opposite, barrel end of the bat to form a barrel region of a second, larger diameter. The two members are tubular or are shaped at their innermost ends to form interengageable region which overlap telescopically at least in a central region of the bat, with the outermost member being shaped in the central region to form a tapering transition zone between the different diameter handle and barrel regions. The members are secured together along the length of the overlap, and the first member is of material having a higher flex modulus than that forming the second member. One or both members may be of fiber reinforced, or composite, plastic material.

30 Claims, 2 Drawing Sheets

BAT FOR BASEBALL OR SOFTBALL

BACKGROUND OF THE INVENTION

The present invention relates generally to bats for use in ball games such as baseball, softball, T-ball and the like.

Traditionally, bats for baseball, softball, and similar games were made of wood. More recently, metallic bats have been introduced. Although more durable than wooden bats, metallic bats are liable to become dented and also have an inferior "feel" or impact as compared to wood. Bats formed of various plastic materials have also been designed, in attempting to duplicate the desirable shock absorbing characteristics of a traditional wooden bat while providing increased strength. Combined aluminum plastic bats have also been proposed in the past.

SUMMARY OF THE INVENTION

It is an object of this invention to provide a new and improved bat for ball games such as baseball, softball, and T-ball.

According to the present invention a bat for baseball, softball or like ball games comprises a handle region of a first diameter extending from a first, butt end of the bat, a barrel region of a second, larger diameter extending from the opposite, forward or barrel end of the bat, and a tapering transition region extending between the handle and barrel regions. The handle region is of a structure having a higher longitudinal flex modulus than the structure forming the barrel region, so that the handle is stiffer and resists high bending loads which peak in the transition region between the handle or gripping zone of the bat and the barrel or hitting zone of the bat.

In a preferred embodiment of the invention, the handle, barrel and transition regions are formed from two telescopically-overlapping tubular members. The members are of plastic material of different longitudinal and cross stiffness in the handle and barrel region. Both members may be of fiber-reinforced plastics or composite material, with the fibers reinforcing one of the members being stiffer than those reinforcing the other tubular member, at least in the respective handle and barrel regions. Alternatively, the fibers reinforcing the material in the handle are oriented mainly lengthwise with just a few angled or cross fibers to resist collapse, while the fibers reinforcing the barrel include a larger member of angled fibers extending across the longitudinal fibers to resist ball impact while still allowing some so-called "trampoline effect" or spring action to restore energy to the ball so it tends to fly farther.

The first tubular member may extend the entire length of the bat and be of reinforced plastic while the second tubular member is a protective sleeve of the same base plastic material without reinforcing fibers. In this case, the fibers reinforcing the first member in the handle region are oriented mainly lengthwise for higher longitudinal stiffness, while the fibers in the barrel region include more angled or cross fibers to increase cross stiffness while still allowing some rebound or trampoline effect.

In other alternative embodiments, one or both members may be solid with a V-shaped intersection between the members in the transition zone. In the latter case, the barrel may be of solid wood, for example, with the handle being of stiffer material.

In one embodiment of the invention, the tubular members overlap only in the transition region, and the tubular member forming the barrel is injection molded over the first tubular member forming the handle in the transition zone to form a strong bond extending the length of the transition region. In an alternative embodi7 ment, the first tubular member extends the entire length of the bat and forms an inner layer of the bat surrounded by the second tubular member, which is secured to the first member along its length by adhesive or any other suitable bonding means. Preferably, the telescopically engaging outer and inner surfaces of the first and second tubular members in the transition zone in both cases are of matching taper, to form a strong taper lock when the surfaces are bonded together. Since the bonding extends over a large surface area, the bond line loads are small and the tendency for the parts to separate is also small or minimal.

Preferably, the wall thickness in the handle region is larger than the wall thickness in the barrel region. The wall thickness along the length of the bat is varied according to the bending loads to which the bat is subjected in use and according to the desired weight, or balance, of the bat.

Butt and barrel end caps are preferably attached to the respective outer ends of the tubular members. Each end cap is preferably of plastic material having the same or lower flex modulus than the other parts of the bat to protect the bat and player from accidental impact. The lower flex modulus of the barrel end cap also permits the cap to flex with the tubular member which will deflect from round on impact with the ball. Suitable gripping material may cover the gripping region of the handle to improve traction, isolate shock, and protect the handle from direct impact. Weights such as lead slugs may be mounted in the butt and barrel end caps to control the location of the center of angular momentum and to give a large moment of inertia to resist the tendency of the bat to rotate on impact.

This bat is designed with a handle of stiffer material more resistant to axial bending loads and a barrel or impact region of a material having less axial stiffness to carry the compression loads, absorb impacts, and protect the more brittle handle material from direct impact. In one preferred embodiment, both handle and barrel are of fiber-reinforced material with the handle end having more longitudinal fibers and the barrel end having more angled fibers to resist collapse but allow for a local trampoline effect with ball impact. The bat can be tailored for players of differing abilities by suitable choice of material for the two tubular members forming the bat. For example, softer materials of lower flex modulus would result in lower power and softer feel for beginners, whereas stiffer or harder materials will result in more power, longer life, and a firmer feel. The stiffness ratio of the two materials forming the two tubular members can be adjusted to give different throw distances and feel, allowing different bats to be provided which are calibrated for different throw distances, giving handicaps for co-ed teams as well as bats particularly suitable for playing on short fields. Generally, a higher stiffness in the barrel will provide a greater throw distance.

Since the entire bat in the preferred embodiment is molded from plastic material, either with a base plastic material forming part of the bat and a composite material forming the remainder, or composite materials of different stiffness forming the entire bat, it can be designed in various colors, with different color sections and also may have graphic designs molded in or silk-screened onto its surface. It is strong and more resistant to damage than wooden or metallic bats, and can be provided in various different calibrated ratings according to the relative stiffness of the materials forming the two tubular members of the bat.

DESCRIPTION OF THE PREFERRED EMBODIMENTS

Figure 1:
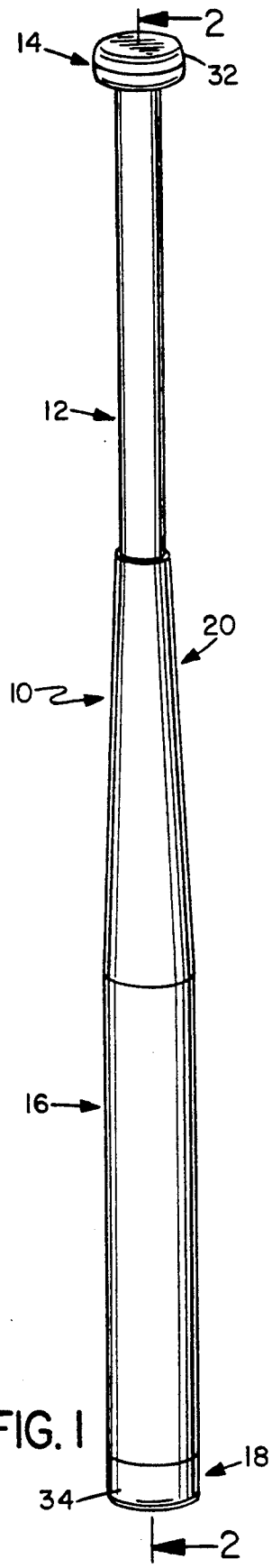
FIG. 1 is a perspective view of the bat, according to a first embodiment of the invention.

FIGS. 1 to 5 of the drawings illustrate a bat 10 for baseball, softball or similar ball games according to a first embodiment of the present invention. The bat is of standard baseball bat configuration, having a handle region 12 of a first diameter extending from a first, butt end 14 of the bat, a barrel or striking region 16 of a second, larger diameter extending from the opposite, forward or barrel end 18 of the bat, and an intermediate, tapering transition region 20 connecting the larger diameter barrel region 16 to the smaller diameter handle region.

The major portion of the bat is formed entirely from first and second tubular members 22, 24 which are preferably each of plastic material and which extend from the respective butt and barrel ends of the bat and overlap telescopically in the transition region with the second tubular member 24 outermost and designed with a tapering outer surface 26 in this region. Preferably, the inner surface 28 of the tubular member 24 is of gradually tapering or reducing diameter in the transition zone with the corresponding outer surface 30 of the first tubular member 22 in this region having a matching taper to form a taper lock. The two members 24, 26 are suitably secured together along the length of the overlapping region. In one preferred embodiment, both members are of the same or compatible thermoplastic material, and the second or outermost tubular member is injection molded over the previously molded inner tubular member to form a bond as the material cools and hardens. Although, in the preferred embodiments illustrated, members 22, 24 are tubular, they may alternatively be of solid construction where lighter weight materials are used, with a v-shaped sliding interlock at the transition, for example. In this case, the barrel may be of wood with an extended indent formed at its inner end to receive an extension of matching shape at the inner or forward end of the handle member.

The two members are of materials having different stiffness, with the first member having a higher flex modulus and therefore being stiffer than the second member. This may be achieved, for example, by making both members of the same base thermoplastic and reinforcing only the first member with suitable unidirectional fibers, or reinforcing both members with the first member being reinforced with stiffer fibers than the second member. In one particular example, the first tubular member forming the handle was of fiberglass-filled nylon 6 while the second tubular member forming the barrel was of softer ABS/nylon alloy. In another example, which is of higher cost but produces a more powerful bat than the first example, the first tubular member was of graphite-filled nylon while the second tubular member was of fiberglass-filled nylon. Other equivalent base plastics and reinforcing fibers may be used to produce different stiffness values in the handle and barrel and different stiffness ratios, varying the feel and throw distance properties of the bat. Since the tougher but softer barrel material covers the more brittle handle material in the transition zone, it will protect this material against impacts, while the stiffer handle material underlying the barrel material resists high bending loads which peak in the transition zone.

Figure 2:
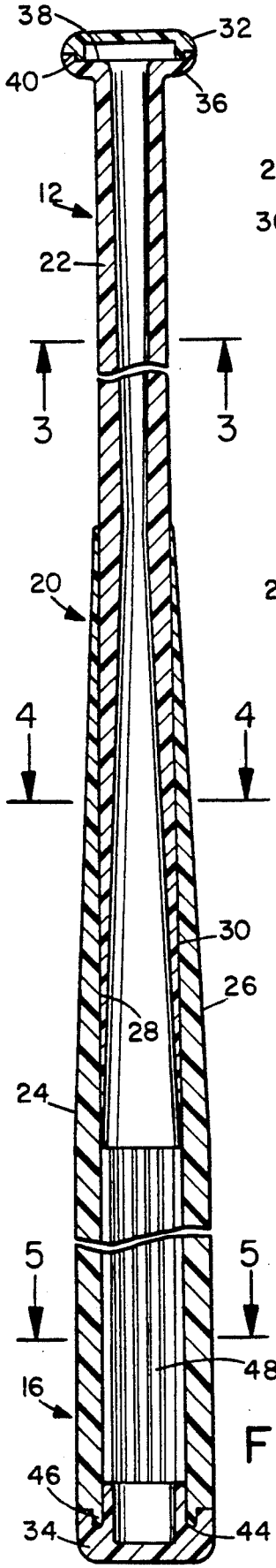
FIG. 2 is an enlarged sectional view taken on line 2—2 of FIG. 1.
Figure 3:
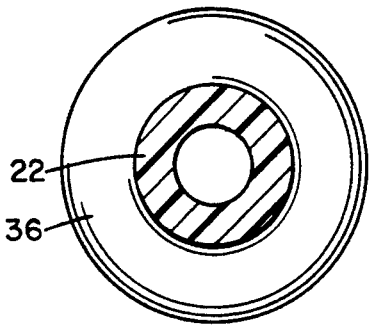
FIG. 3 is an enlarged sectional view taken on line 3—3 of FIG. 2.
Figure 4:
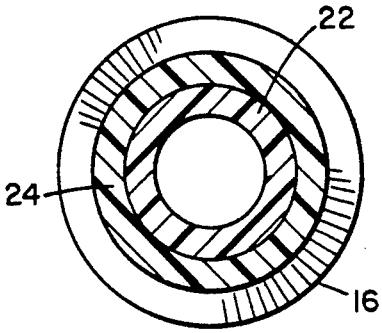
FIG. 4 is an enlarged sectional view taken on line 4—4 of FIG. 2.

End caps 32, 34 of a softer plastic material having a lower flex modulus than the two tubular members are secured at the butt and barrel ends of the bat, as best seen in FIG. 2. These may also be of the same base thermoplastic as the other parts of the bat, but having a lower flex modulus to protect the bat and players from possible injury as a result of accidental impacts. The end caps may be attached by ultrasonic or spin welding or by glue, pinning, or other similar techniques. As illustrated in FIG. 2, the butt end of the first tubular member has an enlarged rim 36 with an indented area 38 in which a rim or skirt 40 of the end cap 32 is seated. The barrel cap 34 has a cylindrical projection 42 which fits into the barrel end of the second tubular member, and an annular groove 44 adjacent projection 42 receives a projecting annular lip 46 at the end of tubular member 24.

Both the first and second tubular members are of varying wall thickness, as best illustrated in FIG. 2, in order to provide a predetermined mass distribution or balance along the bat and provide more strength in areas subjected to more impact and bending loads, while saving material in areas where the loads drop off. The outer diameters at the handle region and barrel region are selected according to standard baseball or softball bat size regulations and are preferably of the order of $2\frac{1}{4}$ to $2\frac{3}{4}$ inches, respectively. The length of the bat is also according to standard regulated bat lengths, and it will be made in various sizes for different types of games, for example 34 inches for a softball bat.

Figure 5:
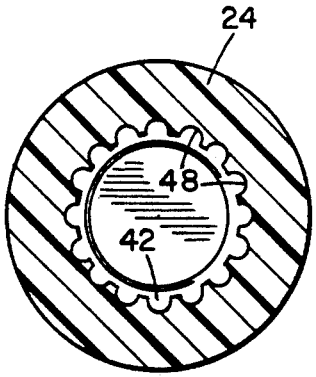
FIG. 5 is an enlarged sectional view taken on line 5—5 of FIG. 2.

At least the second tubular member 24 may have longitudinal grooves 48 formed in its inner surface in the barrel region for increased longitudinal strength, as illustrated in FIGS. 2 and 5. These grooves will stiffen the barrel in the longitudinal direction but allow some flexing in the cross direction on impact, to provide a so-called trampoline effect on the ball so that it tends to fly farther. The grooves will tend to align reinforcing fibers lengthwise along the grooves as member 24 is extruded, giving more longitudinal stiffness to the bat which is needed to reduce the bending on impact, while not significantly increasing the cross-stiffness.

The first or inner tubular member 22 forming the handle region and an inner layer of transition region (see FIGS. 2, 3, and 4) has a maximum wall thickness in the area adjacent the transition where the bending loads will peak. The thickness is tapered back from this area through the handle region towards the butt end, since bending loads drop off in this region and the extra material is not necessary. The wall thickness also tapers forwardly from the maximum thickness area as the increasing diameter of the bat will reduce wall stress, and the overlying portion of the second tubular member can also take up some of this stress. In one specific example, the wall thickness of inner tubular member tapered from a maximum of around ⅛ inch to around 1/16 inch towards the barrel.

The second or outer tubular member 24 forming the barrel and an outer layer of the transition region has a wall thickness which is generally thicker than that of the first tubular member, and is at a maximum wall thickness in the impact area of the barrel. The wall thickness tapers towards the forward or barrel end of the bat where the bending loads are lower, and also tapers rearwardly into the transition region to transfer load to the underlying higher strength layer. In the same example as given above for tubular member 22, the wall thickness of tubular member 24 tapered from a maximum of ⅛ inch in the impact region to around 1/16 inch. The actual wall thickness will be selected according to the regulated bat weight, which typically varies form 24 to 30 ounces for a softball bat, for example.

As mentioned above, all parts of the bat are preferably made of a base thermoplastic or thermoset material, with or without reinforcing fibers. The type and grade of thermoplastic material, as well as the type of reinforcing fibers, will determine stiffness and strength of various regions of the bat, and can be used to control the "feel" and "throw distance" of the bat. One suitable base thermoplastic material is nylon, for example. Both the tubular members and end caps may be made form the same base thermoplastic by injection molding. For example, the first tubular member may be of ABS/nylon alloy material, while the end caps may be of a softer nylon material, with a lower flex modulus. This would produce a bat with a relatively soft "feel" and low power. In another example, using higher cost materials, the first tubular member may be of graphite-filled nylon 6/12 composite or similar materials, the second tubular member may be of a softer material such as super tough nylon, while the end caps are again of softer nylon material. This would give more power, longer life, and a firmer feel. The first or inner tubular member preferably has a flex modulus of $10^6$ or more, but the flex modulus should at least be greater than 4 or $5\times10^5$, while the second or outer tubular member should have a flex modulus of around 2 or $3\times10^5$.

The first and second tubular members are formed by injection molding, with the second tubular member being molded over the first member so that the overlapping surfaces will harden and bond together to form a strong connection. Since the parts are bonded over a large surface area forming a taper lock, they will be unlikely to separate even under very high loads.

The stiffer tubular member forming the handle region provides resistance to bending loads which peak in the transition region, and is protected from impacts in this region by the overlying layer of the softer, second tubular member. The softer material of the second tubular member in the barrel will absorb impacts and carry bending loads. The relatively soft barrel end cap allows for flexing of the barrel tube on impact. The ratio of stiffness of the materials forming the handle and barrel is a critical factor in determining throw distance and feel. Thus, bats can be designed for varying throw distances and players of differing abilities.

Preferably, the handle region is covered by a suitable gripping material of the standard type used on sporting equipment handles to improve traction and reduce shock to the hand. Since the bat is formed entirely of plastic material, it will be resistant to corrosion, chipping, and other types of damage. It can be designed with different color sections for attractive appearance and may be color-coded according to calibrated throw distances, for example. Graphic designs may be molded in or silkscreened onto the outer surface of the bat. The bat may be wood-grained or metallized, if desired to look like a wooden or metal bat. Alternatively, the surface may be photo engraved with patterns or graphics. Thus, a wide variation in appearance of the bat is possible with this construction. The bat may be relatively inexpensive, according to the material selected, and has a relatively long effective lifetime. The soft end caps will reduce the risk of accidental injuries.

FIGS. 6 to 10 illustrate a modified bat according to a second embodiment of the invention. As in the first embodiment, the bat includes a handle region 52, a larger diameter barrel or impact region 54, and a tapering, transition region 56 between the handle and the barrel. The bat is basically formed from first and second tubular members 58, 60, as in the previous embodiment, but in this case the first tubular member 58 extends the entire length of the bat. The second or outer tubular member 60 is a protective sleeve which engages telescopically over the inner member 58 in the transition and barrel regions, and is of a material having a lower flex modulus than that forming the inner member 58.

Figure 6:
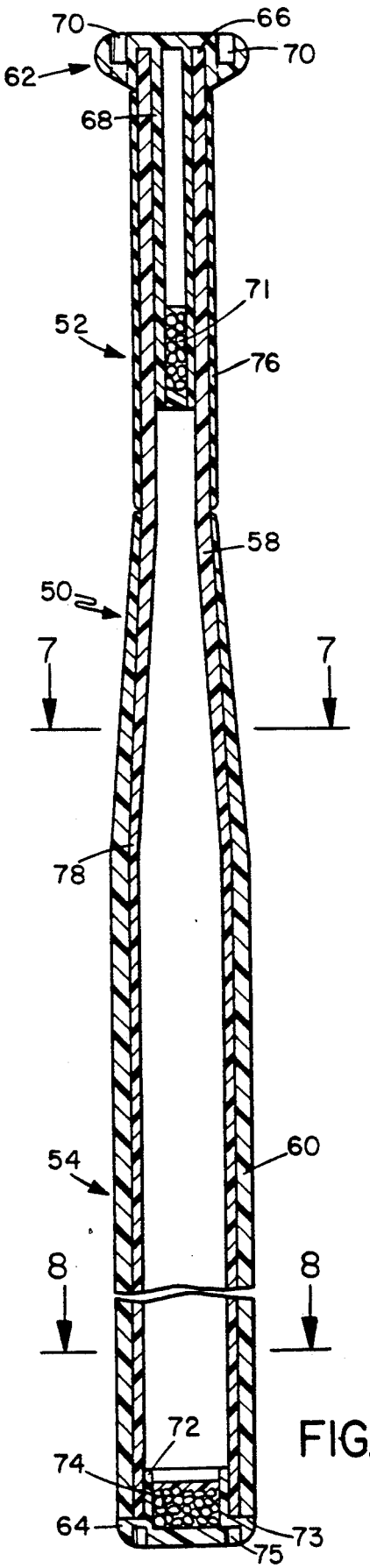
FIG. 6 is a sectional view similar to FIG. 2; showing an alternative embodiment of this invention.
Figure 9:
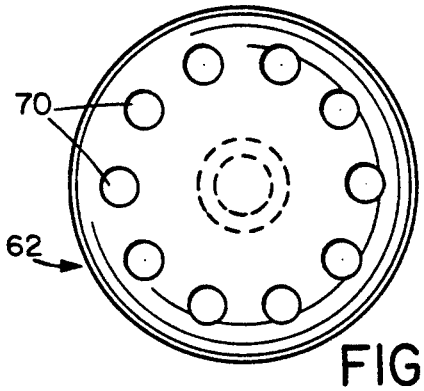
FIG. 9 is an end view of the handle end of the bat.
Figure 7:
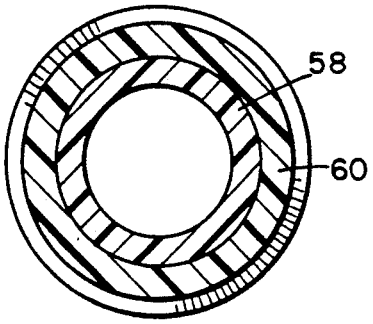
FIG. 7 is a sectional view taken on line 7—7 of FIG. 6.
Figure 8:
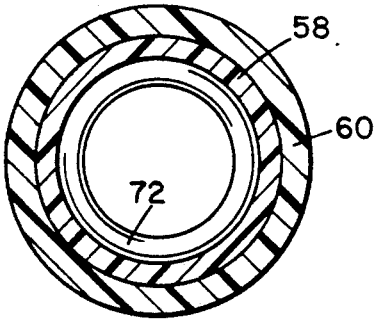
FIG. 8 is a sectional view taken on line 8—8 of FIG. 6.
Figure 10:
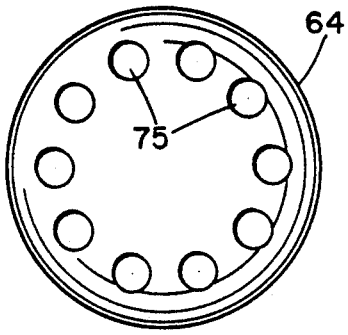
FIG. 10 is an end view of the barrel end of the bat.

End caps 62, 64 are fitted onto the opposite butt and barrel ends of the bat, as illustrated in FIG. 6. Butt end cap 62 comprises a generally annular member having an annular groove 66 on its inner face for receiving the butt end of tubular member 58, and a hollow, elongated shank 68 projects from the inner face of the end cap into the end of tubular member 58. The end cap is secured in place by gluing and pinning. The outer face of the end cap is provided with a series of holes or blind bores 70 arranged in a ring as illustrated in FIG. 9. Bores 70 may extend through the entire thickness of the rim of end cap 62, as illustrated in dotted outline in FIG. 6. A slug 71 of lead shot or the like is inserted in the bore of shank 68 to add a predetermined amount of weight at the handle end.

End cap 64 is an annular member with a short projecting shank 72 projecting into the barrel end of member 58 and a rim 73 which butts up against the ends of member 58 and outer member or sleeve 60. It is secured in place by gluing, pinning or the like. A quantity or slug of lead weight or shot 74 is embedded in end cap 64 to add a predetermined amount of weight to the barrel end of the bat. The outer end face of end cap 64 is also provided with a plurality of circular recesses or holes 75 projecting into the cap. Holes 70 and 75 reduce the weight and thus the materials needed for the end caps. The handle region is covered by a suitable gripping material layer 76 which may be an adhesive strip wound over the handle region.

Both tubular members have varying outer and inner diameters and wall thicknesses. The inner tubular member has a substantially constant outer diameter in the handle region 52 and an outwardly tapering outer diameter or surface 78 in the transition region between the handle and barrel, with a substantially constant outer diameter in the barrel region. The second tubular member has an inner diameter matching the outer diameter of the first tubular member 58 along its length, forming a taper lock in the transition region. The outer and inner tubular members are preferably secured together by a suitable semi-flexible adhesive such as an epoxy resin to allow for flexing of the barrel under impact loads. The adhesive may be painted onto the outer surface of member 58 in the appropriate areas before sliding the outer member into position over member 58 and allowing the adhesive to set.

The wall thickness of the first tubular member 58 is at a maximum in the area extending from the handle to the transition region where bending loads will be high, and tapers from this area both towards the butt end of the bat and towards the barrel region. The thickness may taper from ⅛ inch to 1/16 inch. The wall thickness of outer member 60 in the barrel is preferably of the order of ⅛ to 1/16 inches. The outer surface 80 is tapered in the transition zone.

As mentioned above, the outer tubular member forming the outer layer of the barrel is of a suitable plastics material having a lower flex modulus than the material forming at lest the handle region of the first tubular member. The first tubular member is preferably designed to have a varying flex modulus or stiffness, having more longitudinal stiffness in the handle region than in the barrel. This may be done, for example, by forming the member 58 from fiber reinforced plastics material, changing from a stiffer fiber at the handle end to a less stiff fiber at the barrel end. In one particular embodiment the first tubular member 58 was formed of a reinforced thermoset epoxy resin, using lower stiffness reinforcing fibers such as fiberglass or aramid in the barrel region and higher stiffness fibers such as graphite or boron in the handle region and at least part of the transition region.

In an alternative embodiment, the same fibers may be used along the entire length of tubular member 58, simply changing their orientations to provide varying longitudinal and cross stiffness. This may be done in a conventional filament-winding process in which graphite fibers are wound at the desired orientations on a mandrel. In the handle region, high longitudinal stiffness is needed but little cross stiffness will be required. Thus, the majority of fibers will extend lengthwise in the handle region, with only a few cross or angled fibers to resist buckling. In the barrel region, in contrast, higher cross stiffness will be needed to resist collapsing or ball impact. Thus, a greater number of fibers will be angled at ±45° in the barrel region. For example, with 16 plies of fibers, ten may extend lengthwise while six are angled in the barrel region, as opposed to only one or two angled in the handle region. Although the cross stiffness must be sufficient in the barrel to resist collapse, some indenting of the barrel on impact is desirable in order to produce a rebound or trampoline effect so that the ball is pushed farther by the bat. Thus, a crosswise modulus of elasticity of around 1 to 4 mill. is preferred in order to avoid breakage while still producing a trampoline effect, while the lengthwise modulus of elasticity should be around 10–20 mill. to resist bending. The part can be manufactured by winding axial unidi7 rectional fibers, covered by varying numbers of cross plies, around a suitably shaped mandrel, and impregnating with epoxy resin binder. It may alternatively be made by roll-wrapping or resin transfer molding. The part is then compressed, cured and baked in a manner well known in the field of composite material forming.

The inner tubular member 58 in this version may also have longitudinal grooves along its entire length, simi7 lar to grooves 48 formed in member 24 in the first embodiment. Again, the grooves will inherently increase the longitudinal stiffness, and will also tend to align fibers lengthwise along the grooves. This will also increase longitudinal stiffness without increasing cross-stiffness.

The stiffer structure in the handle region is needed to handle the high bending loads which peak at the transition from the handle into the tapered transition region. The increased wall thickness in the area around this transition also helps to withstand bending loads. The stiff longitudinal reinforcing fiber content can drop off forward of this point, as does the wall thickness, since axial bending loads will drop off as the bat diameter increases, while the cross fibers increase as noted above. The material in the barrel section of inner member 58 has a high strain to failure coefficient in the compression mode as well as good impact and fatigue resistance. The flex modulus of the material forming the inner tubular member preferably varies from a high of around 2–4 mill. in the handle to a low of around 1–2 mill. in the barrel.

Since the bat is of hollow construction and the materials used are relatively lightweight, end weights 71, 74 can be provided in the end caps to bring the bat to the standard weight (typically 26, 28, 30 and 32 oz.). This allows greater control of the location of the sweet spot or center of momentum, and also allows the bat to have a large moment of inertia to resist rotation if hit off-center. Typically, the weight 74 added at the barrel end will be greater than at the handle end, so that the center of momentum is fairly far out along the barrel.

Where the bat without any added weights has a weight of 24 oz., a 1½ oz. weight may be added to the barrel while a slug 71 of ½ oz. in weight may be inserted in the handle end cap. Slug 71 can be moved along the length of shank 68 to alter the hitting properties.

The second or outer tubular member 60 is formed from injection molded thermoplastic resin such as polycarbonate having a lower flex modulus than the material of inner member 58 in the handle region. One suitable material for forming member 60 is fiber-glass reinforced nylon. Both the butt and barrel caps are preferably formed of suitable thermoplastic material. The barrel cap is preferably of the same base thermoplastic as the barrel, but having a lower flex modulus, and may be attached by ultrasonic or spin welding to the barrel. The inner part of the butt end cap is of lower flex modulus than the handle and is glued and pinned to the end of the handle. The outer end part is of a lower modulus version of the same thermoplastic as inner end part, and is preferably attached by ultrasonic or spin welding. The barrel and butt end caps may be of nylon, for example, having a lower flex modulus to protect both players and bat from accidental impacts. The low flex modulus of the barrel end cap is also important to allow it to flex with a barrel deflection on impact.

All of the basic parts of the bat, including end caps, in both embodiments described above, can be texturized and colored as desired for various surface appearances. The end caps can be engraved and hot stamped. Graphic designs may be silk screened or molded in at any desired area on the bat surface, or the surface may be photo-engraved.

The plastic baseball bat of this invention is strong and hard-wearing, and made to have a higher longitudinal stiffness at the handle than in the barrel to resist high bending loads which occur at the transition from the handle to the tapered transition region. The tube of more resilient, less brittle material forming the barrel also covers the member forming the handle in the transition zone to protect the more brittle material of that member from direct impact. Soft end caps protect both players and bat from accidental impact. The bat may be partially or entirely formed from fiber reinforced or composite plastic material, and can be custom-designed according to the flex modulus of the materials used for each part of the bat in order to give a desired "feel" and "throw distance" for players of differing capabilities and for playing on different length fields. The wall thickness and/or material density can be varied according to the desired mass distribution along the bat to produce a predetermined balance. It can also be easily custom-designed in various different colors and surface designs and textures, to provide bats of modern and attractive appearance.

Although some preferred embodiments of the invention have been described above by way of example only, it will be understood by those skilled in the field that modifications may be made to the disclosed embodiments without departing from the scope of the invention, which is defined by the appended claims.

I claim:

1. A bat for sporting games, comprising:

a first hollow tubular member having opposite outer and inner ends, the first member outer end being located at a first, butt end of the bat, the first tubular member extending from said butt end to form a handle region of a first diameter;

a second hollow tubular member having opposite outer and inner ends, the second member outer end being located at the opposite, barrel end of the bat, the second tubular member extending from said barrel end to form a barrel region of a second, larger diameter having a hollow core;

the inner end of said first member extending telescopically into the inner end of said second member to form a telescopically overlapping region extending at least along a mid-section of the bat extending between said barrel and handle regions;

the second member which is outermost in said mid-section being shaped to form a tapered transition zone between said different diameter handle and barrel regions, and said members being permanently secured together;

said second member extending up to a junction between said tapered transition zone and handle region, the inner end of said second member being located approximately at said junction; and the first and second members being formed of different materials, the material forming said first member having a higher longitudinal flex modulus than that forming said second member.

2. The bat as claimed in claim 1, wherein said tubular members are each of reinforced, thermoplastic material.

3. The bat as claimed in claim 2 wherein the first tubular member is a fiber-reinforced composite material.

4. The bat as claimed in claim 1, wherein the first tubular member is of reinforced thermoset epoxy resin.

5. The bat as claimed in claim 1, wherein the inner surface having grooves which extend longitudinally along the barrel region only.

6. The bat as claimed in claim 1, wherein said second tubular member has a substantially constant outer diameter in said barrel region and is of gradually reducing outer diameter along the length of said transition zone towards said handle region, the wall thickness of said second tubular member being a maximum in said barrel region, tapering from said maximum along said transi7 tion zone towards the butt end of the bat.

7. The bat as claimed in claim 1, including a separate barrel cap secured over the outer end of said second tubular member.

8. The bat as claimed in claim 7, wherein said barrel cap is of a material having a lower flex modulus than that of said barrel end.

9. The bat as claimed in claim 8, wherein the barrel cap includes weight-adding elements for providing a predetermined weight at the barrel end of the bat.

10. The bat as claimed in claim 9, including a butt cap secured over the butt end of said first tubular member.

11. The bat as claimed in claim 10, wherein the butt cap is of a material having a lower flex modulus than that of said handle region.

12. The bat as claimed in claim 10, including a weighted slug mounted in said butt cap.

13. The bat as claimed in claim 11, wherein the tubular members, butt cap and end cap are all of thermoplastic material.

14. The bat as claimed in claim 1, wherein the second member is of a substantially non-compressible material having substantially no pore spaces.

15. The bat as claimed in claim 1, including a cushioning layer covering the handle region and extending up to the inner end of the second tubular member at the junction between the handle region and tapered transi7 tion zone.

16. The bat as claimed in claim 1, wherein the first tubular member is of fiber-reinforced thermoplastic material and the second tubular member is of thermoplastic material without reinforcing fibers.

17. The bat as claimed in claim 1, wherein the second tubular member is of a non-foamed material, the second tubular member being pre-formed separately from said first tubular member and bonded to said first tubular member.

18. The bat as claimed in claim 1, including an adhesive bonding layer between said first and second members extending along at least part of said overlapping region, the bonding layer being of an at least partially flexible adhesive material to allow for flexing of the barrel under impact loads.

19. The bat as claimed in claim 3, wherein said thermoplastic material is nylon.

20. The bat as claimed in claim 19, wherein the first tubular member is of graphite-filled nylon and the second tubular member is of fiberglass-filled nylon.

21. A bat for sporting games, comprising:

a first hollow tubular member having opposite first and second ends, the first member first end being located at a first, butt end of the bat, the first member extending from said butt end to form a handle region of a first diameter;

a second member having opposite first and second ends, the second member first end being located at an opposite, barrel end of the bat, the second member extending from said barrel end to form a barrel region of a second, larger diameter;

said first and second members extending beyond said handle and barrel regions, respectively, and the second end of said first member extending telescopically into the second end of said first member to form a telescopically overlapping region between said handle and barrel regions;

the second member which is outermost in said overlapping region being shaped to form a tapered transition zone extending between said different diameter handle and barrel regions;

the members being secured together in said overlapping region;

the first member extending over only said butt region and tapered transition zone and terminating short of the barrel end of the bat; and the second member extending over only said barrel region and tapered transition zone and terminating short of the handle end of the bat.

22. A bat for sporting games, comprising:

a first member having opposite outer and inner ends, the first member outer end being located at a first, butt end of the bat, the first member extending from said butt end to form a handle region of a first diameter having an inner end spaced from said butt end;

a second member having opposite outer and inner ends, the second member outer end being located at the opposite, barrel end of the bat, the second member extending from said barrel end to form a barrel region of a second, larger diameter having an inner end spaced from said barrel end;

at least the second member being a hollow tubular member and the inner end of said first member extending telescopically into the inner end of the second, tubular member to form a telescopically overlapping region;

the second member being shaped to form a tapered transition zone extending between the inner ends of said different diameter handle and barrel regions, and said members being secured together along the length of the overlap;

the first and second members being formed of different materials, the material forming said first member having a higher longitudinal flex modulus than that forming said second member; and the first member extending the entire length of said bat to form an inner layer in said transition zone and barrel region, and said second member comprising a protective sleeve extending over the first member in the barrel and transition region and terminating approximately at the inner end of said handle region.

23. The bat as claimed in claim 22, wherein at least the first member is of reinforced plastic material.

24. The bat as claimed in claim 23, wherein said first member is of a material having a lower longitudinal flex modulus in said barrel region than in said handle region.

25. The bat as claimed in claim 24, wherein said first and second members are tubular and the material forming said first tubular member is reinforced with fiber having a lower stiffness in said barrel region than the fibers reinforcing said material in said handle region.

26. The bat as claimed in claim 25, wherein the majority of fibers in said barrel region are selected from the group consisting of: fiberglass and aramid; and the majority of fibers in said handle region are selected from the group consisting of: graphite and boron.

27. The bat as claimed in claim 24, wherein the base material forming said first member is reinforced with fibers, a larger number of fibers being oriented crosswise in the barrel region than in the handle region to provide higher cross stiffness in the barrel region to resist collapse on ball impact.

28. A bat for sporting games, comprising:

a first hollow tubular member having opposite outer and inner ends, the first member outer end being located at a first, butt end of the bat, the first tubular member extending from said butt end to form a handle region of a first diameter;

a second hollow tubular member having opposite outer and inner ends, the second member outer end being located at the opposite, barrel end of the bat, the second tubular member extending from said barrel end to form a barrel region of a second, larger diameter;

the inner end of one of said first and second members extending telescopically into the inner end of the other said member to form a telescopically overlapping region extending at least along a mid-section of the bat extending between said barrel and handle regions;

the other said member which is outermost in said mid-section being shaped to form a tapered transi7 tion zone between said different diameter handle and barrel regions, and said members being secured together along the length of the overlap;

the first and second members being formed of different reinforced, thermoplastic materials, the material forming said first member having a higher longitudinal flex modulus than that forming said second member; and the first and second tubular members each being of injection molded thermoplastic, the second tubular member being injection molded over the first tubular member along the length of the overlap to form a bond.

29. A bat for sporting games, comprising:

a first hollow tubular member having opposite outer and inner ends, the first member outer end being located at a first, butt end of the bat, the first tubular member extending from said butt end to form a handle region of a first diameter;

a second hollow tubular member having opposite outer and inner ends, the second member outer end being located at the opposite, barrel end of the bat, the second tubular member extending from said barrel end to form a barrel region of a second, larger diameter;

the first member extending partially into the inner end of the second member to form a telescopically overlapping region extending at least along a mid-section of the bat extending between said barrel and handle regions;

the second member which is outermost in said mid-section being shaped to form a tapered transition zone between said different diameter handle and barrel regions, and said members being secured together along the length of the overlap;

the first and second members being formed of different materials, the material forming said first member having a higher longitudinal flex modulus than that forming said second member; and the wall thickness of said first tubular member varying along its length, the thickness being at a maximum in an area extending from said handle region into said transition zone, the wall thickness tapering from said maximum thickness area towards said first end of the bat.

30. The bat as claimed in claim 29, wherein said wall thickness tapers from said maximum thickness area forwardly along said transition zone.

* * * * *

UNITED STATES PATENT AND TRADEMARK OFFICE

CERTIFICATE OF CORRECTION

PATENT NO. : 5,303,917

DATED : APRIL 19, 1994

INVENTOR(S) : ALAN K. UKE

It is certified that error appears in the above-indentified patent and that said Letters Patent is hereby corrected as shown below:

-- Column 10, line 6, after "wherein the" insert --second tubular member has an--.

Signed and Sealed this

Twenty-fifth Day of October, 1994

*Attest:*

*Attesting Officer*

Bruce Lehman

BRUCE LEHMAN

*Commissioner of Patents and Trademarks*